US011624117B2

(12) United States Patent
Madhusudan

(10) Patent No.: US 11,624,117 B2
(45) Date of Patent: Apr. 11, 2023

(54) ELECTROCHEMICAL COMPRESSOR ARCHITECTURE

(71) Applicant: Bell Textron Inc., Fort Worth, TX (US)

(72) Inventor: Phalgun Madhusudan, Fort Worth, TX (US)

(73) Assignee: TEXTRON INNOVATIONS INC., Providence, RI (US)

( * ) Notice: Subject to any disclaimer, the term of this patent is extended or adjusted under 35 U.S.C. 154(b) by 17 days.

(21) Appl. No.: 17/332,743

(22) Filed: May 27, 2021

(65) Prior Publication Data

US 2022/0381229 A1 Dec. 1, 2022

(51) Int. Cl.

| | |
|---|---|
| ***C25B 9/21*** | (2021.01) |
| ***C25B 1/02*** | (2006.01) |
| ***F04B 45/047*** | (2006.01) |
| ***F04B 45/027*** | (2006.01) |
| *F04B 43/04* | (2006.01) |

(52) U.S. Cl.

CPC ..... *C25B 9/21* (2021.01); *C25B 1/02* (2013.01); *F04B 45/027* (2013.01); *F04B 45/047* (2013.01); *F04B 43/04* (2013.01)

(58) Field of Classification Search

None

See application file for complete search history.

(56) References Cited

U.S. PATENT DOCUMENTS 6,685,821 B2 2/2004 Kosek et al.
2004/0142215 A1* 7/2004 Barbir ..... H01M 8/2457 429/411
2004/0211679 A1 10/2004 Wong et al.
2010/0132386 A1* 6/2010 Bahar ..... F25B 1/00 62/115
2017/0082328 A1* 3/2017 Bahar ..... F25B 1/00

FOREIGN PATENT DOCUMENTS

FR 3007669 A1 1/2015

OTHER PUBLICATIONS

Durmus et al, A review on the development of the electrochemical hydrogen compressors, Journal of Power Sources, vol. 494, May 2021, article 229743, pp. 1-17 (Year: 2021).*

Chouhan et al, Analysis of an electrochemical compressor stack, International Journal of Hydrogen Energy, vol. 45, No. 56, Nov. 2020, pp. 31452-31465 (Year: 2020).*

* cited by examiner

*Primary Examiner* — Harry D Wilkins, III

(74) *Attorney, Agent, or Firm* — Slater Matsil, LLP

(57) ABSTRACT

An electrochemical compressor, including a first end plate, a second end plate, a voltage supply connected to the first end plate and second end plate, a plurality of membranes, where each membrane of the plurality of membranes has a substantially same impedance, and where each membrane of the plurality of membranes has a different thickness in a stacking direction, and a plurality of conductive bipolar plates, where the bipolar plates of the plurality of bipolar plates are arranged in contact with, and alternating in the stacking direction with, the membranes of the plurality of membranes, and where the membranes of the plurality of membranes and the bipolar plates of the plurality of bipolar plates are electrically connected in series between the first end plate and second end plate.

20 Claims, 4 Drawing Sheets

ELECTROCHEMICAL COMPRESSOR ARCHITECTURE

TECHNICAL FIELD

The present invention relates generally to a system and method for providing an electrochemical hydrogen compressor, and, in particular embodiments, to a system and method for providing a multistage hydrogen compressor with stage membrane thicknesses and materials selected to improve compressor efficiency.

BACKGROUND

Generally, stored hydrogen is compressed to process the gas for more economic storage. The small size of hydrogen gas molecules makes the gas difficult to compress with conventional pumped compressors. However, the small size and simple nature of the hydrogen gas molecule lends itself to use of electrochemical hydrogen compressors with no moving parts.

In order to achieve the desired pressures for compressed hydrogen, electrochemical compressors may use multiple compression stages, with each stage using direct current to drive hydrogen ions or protons through a membrane. These stages are typically stacked vertically, and the stages are electrically powered, operated or driven in parallel. This arrangement results in a complex design that required special manufacturing and handling.

SUMMARY

An electrochemical compressor according to the presented principles includes a first end plate, a second end plate, a voltage supply connected to the first end plate and second end plate, a plurality of membranes, where each membrane of the plurality of membranes has a substantially same impedance, and where each membrane of the plurality of membranes has a different thickness in a stacking direction, and a plurality of conductive bipolar plates, where the bipolar plates of the plurality of bipolar plates are arranged in contact with, and alternating in the stacking direction with, the membranes of the plurality of membranes, and where the membranes of the plurality of membranes and the bipolar plates of the plurality of bipolar plates are electrically connected in series between the first end plate and second end plate.

An embodiment electrochemical compressor includes a first end plate, a second end plate, a high pressure gas outlet, a low pressure gas input, a plurality of membranes, where each membrane of the plurality of membranes has a substantially same impedance, and where each membrane of the plurality of membranes has a different thickness in a stacking direction, a plurality of conductive plates, where the plates of the plurality of plates are arranged in contact with, and alternating in the stacking direction with, the membranes of the plurality of membranes, and where the membranes of the plurality of membranes and the plates of the plurality of plates are electrically connected in series between the first end plate and second end plate, and a voltage supply connected to the first end plate and second end plate, the voltage supply configured to apply a voltage across the membranes in series, where the voltage causes the membranes to compress a gas provided at the low pressure gas input and to provide pressurized gas at the high pressure gas outlet.

An embodiment method of forming an electrochemical compressor includes providing a first end plate, providing a second end plate, providing a voltage supply electrically connected to the first end plate and second end, providing a plurality of membranes, where each membrane of the plurality of membranes has a substantially same impedance, and where each membrane of the plurality of membranes has a different thickness in a stacking direction, providing a plurality of conductive bipolar plates, and arranging the bipolar plates of the plurality of bipolar plates in contact with, and alternating in the stacking direction with, the membranes of the plurality of membranes, where, after the arranging, the membranes of the plurality of membranes and the bipolar plates of the plurality of bipolar plates are electrically connected in series between the first end plate and second end plate.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Illustrative embodiments of the system and method of the present disclosure are described below. In the interest of clarity, all features of an actual implementation may not be described in this specification. It will of course be appreciated that in the development of any such actual embodiment, numerous implementation-specific decisions may be made to achieve the developer's specific goals, such as compliance with system-related and business-related constraints, which will vary from one implementation to another. Moreover, it should be appreciated that such a development effort might be complex and time-consuming but would nevertheless be a routine undertaking for those of ordinary skill in the art having the benefit of this disclosure.

Reference may be made herein to the spatial relationships between various components and to the spatial orientation of various aspects of components as the devices are depicted in the attached drawings. However, as will be recognized by those skilled in the art after a complete reading of the present disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 1:
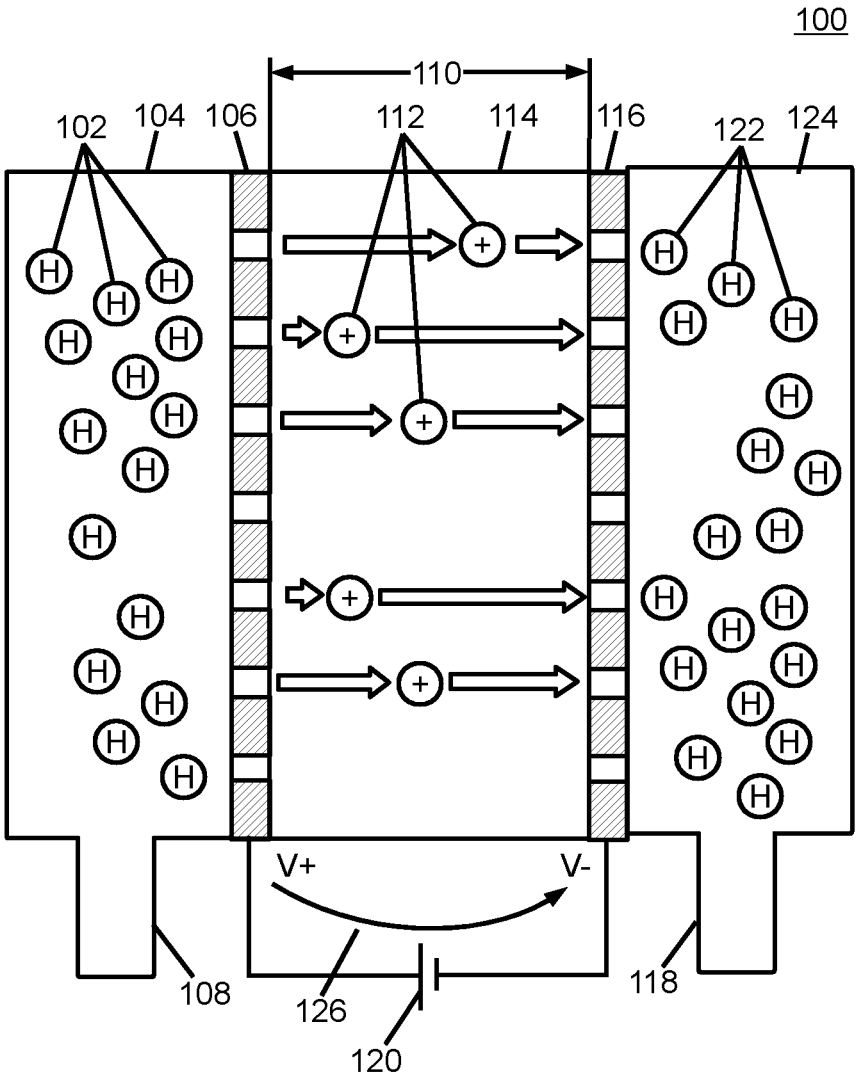
FIG. 1 is a diagram illustrating operation of a compressor stage according to some embodiments.

FIG. 1 is a diagram illustrating operation of a electrochemical hydrogen compressor (EHC) stage 100 according to some embodiments. The compressor has a low pressure side 104 that accepts low pressure hydrogen 102 supplied through a low pressure input 108. A voltage may be applied across an electrode pair 106, 116, with an anode 106 acting as a positive terminal and a cathode 116 acting as a negative terminal for a voltage source 120. The anode 106 and cathode 116 are disposed on opposite sides of a membrane 114 to form a membrane electrode assembly (MEA). In some embodiments, a catalyst layer (not shown) may also be provided between the cathode 116 and the membrane 114, and between the anode 106 and the membrane 114. The catalyst layer may use a platinum catalyst on a carbon supporting structure, or may be another catalyst or other supporting structure.

The membrane 114 may be a selective membrane such as a proton exchange membrane (PEM) formed from material such as perfluorosulfonic acid ionomers (PFSA), for example, Nafion®, biphenyl sulfone hydrocarbons (BPSH) membranes, for example, BPSH-35, aromatic-base membranes such as sulfonated aromatic polymers (SAP) or sulfonated poly (ether ether ketone) (SPEEK), metallic membranes, nanoporous ceramic or glass membranes, solid electrolyte membranes, or the like. The electrodes 106, 116 may be metallic or metallic alloys, such as copper, titanium, aluminum, or noble metals, or the like, or may be another conductive material such as a composite with metal in a solid electrolyte matrix (cermet), or the like. The electrodes 106, 116 may be formed as a porous foil or perforated sheet to allow movement of water and hydrogen molecules and ions though the respective electrode 106, 116.

The EHC process involves low pressure hydrogen being fed into the anode 106, where hydrogen oxidation reactions (HORs) occur to split hydrogen into protons and electrons, before being transported across the membrane 114 to the cathode 116 side where hydrogen evolution reactions (HERs) occur to reform hydrogen.

The voltage applied by the voltage source 120 to the electrodes 106, 116 pulls electrons from the low pressure hydrogen 102, leaving bare protons or hydrogen ions 112 that move across the membrane 114, and provides a current 126 moving the electrons to the cathode 116 for the HERs. The one way nature of the membrane 114, in combination with the voltage provided by the voltage source 120, drives the low pressure hydrogen 102 through the membrane 113, to a high pressure side where it is collected as high pressure hydrogen 122, and removed via a high pressure outlet 118.

The membrane has a thickness 110 that is associated with the ability to provide a pressure differential between the low pressure side 104 and the high pressure side 124, and also with the overall pressure at the high pressure side. Generally, a thicker membrane 114 is used for higher pressures. In part, this is to provide the physical strength to resist the pressure at the high pressure side 124. However, the thickness 110 of the membrane 114 also controls the membrane ability to resist diffusion of the high pressure hydrogen 122 back into the low pressure side 104, and to resist diffusion of contaminants from the low pressure side 104 to the high pressure side 124. The current density over the surface of the membrane 114 contributes to the efficiency at which the EHC compressor stage 100 operates, and the pressure differential achieved by the EHC compressor stage 100. The current density is related to the voltage applied to the membrane 114, as well as the impedance of the membrane 114. For a given material, the thickness 110 of the membrane 114 is associated with the impedance, with a higher impedance resulting from a greater thickness 110. The impedance is also a function of the membrane 114 chemistry. Adjusting the chemistry of the membrane for various thicknesses permits the design of a multistage EHC with different stages tuned for the associated impedance, and desired pressure for the stage.

Some embodiments of the presented principles are directed to an arrangement for a multistage EHC with no moving parts and with stages having matched impedances, permitting the stages to be electrically operated in series, similar to the operation of a fuel cell. This permits operation without specialized equipment, and improves portability of the multistage EHC. Additionally, providing a multistage EHC with the stages electrically connected in series avoids the need for stage-by-stage control of the voltages. In other embodiments, different membranes may be used so that different pressures can be obtained in the same stack.

Figure 2:
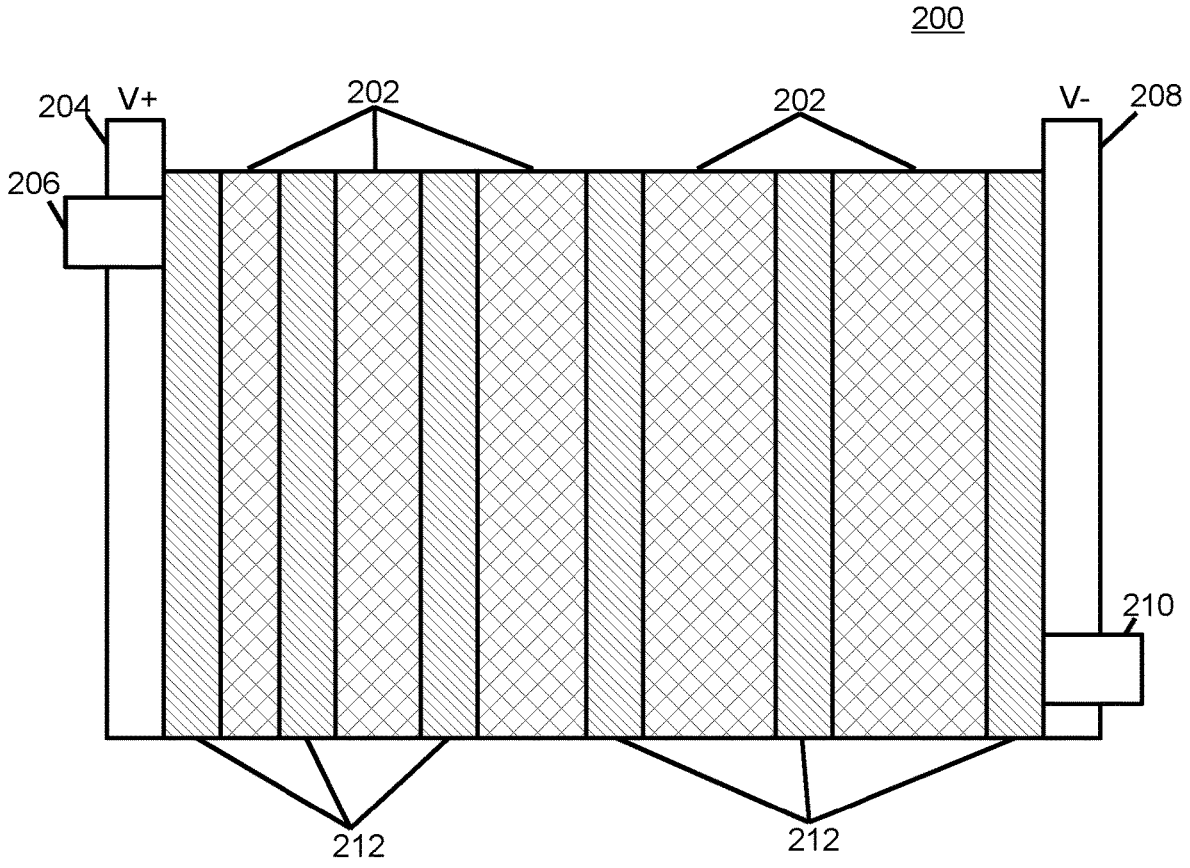
FIG. 2 is a diagram illustrating an electrochemical hydrogen compressor with stages electrically connected in series according to some embodiments.

FIG. 2 is a diagram illustrating an electrochemical hydrogen compressor 200 with stages electrically connected in series according to some embodiments. A series of stages are formed from a plurality of membranes 202 and a plurality of bipolar plates 212 disposed between a positive end plate 204 and a negative end plate 208. The bipolar plates 212 and membranes 202 alternate, so that the membranes 202 are each disposed between a pair of bipolar plates 212, with each compressor stage formed by a membrane 202 and two bipolar plates 212.

The bipolar plates 212 are the electrically conducting plates which connect the anode of one cell to the cathode of another cell. The bipolar plates 212 may be, for example, a graphite polymer composite, a metal such as steel or stainless steel, titanium, copper, molybdenum, aluminum, nickel, or a metal alloy, or another conductive material. The bipolar plates 212 are configured to pass hydrogen directly between stages or membranes 202, and have pores, holes, or field flow openings permitting the accumulation and movement of hydrogen gas.

Equal pressure gains at each stage of compression increase the efficiency of the overall compressor, and can be achieved by having substantially the same voltage drop across each stage. With the stages being electrically connected in series, the same voltage drop can be achieved with substantially the same impedance in each membrane or stage. However an identical pressure gain in each stage causes higher differential pressures across each subsequent membrane. In some embodiments, the membranes 202 for each stage are formed using nanofillers and cast into varying thicknesses to achieve substantially the same impedance for membranes of different thicknesses. In some embodiments, a variance of 5% in impedance may be achieved, and in other embodiments, a variance of 1% may be achieved. Each of the membranes may have a same base material, and may have the impedance adjusted using a filler, so that the concentration of base material in the membranes 202 is different for each membrane. Additionally, the thickness of each membrane 202 may be related to the concentration of the base material.

The impedances for each membrane may be normalized by reducing the impedance, or increasing the conductivity, of each membrane to match the impedance of the thinnest membrane. Alternatively, the impedance for each membrane may be normalized by increasing the impedance, or reducing the conductivity, of each membrane to match the impedance of the thickest membrane.

In some embodiments, fillers that improve conductivity to normalize impedances to match the impedance of thinnest membrane are polymeric or ionic, for example imidazolium methanesulphonate, 1,2,4-triazolium perfluorobutanesulphonate crystals, or the like. In some embodiments, a filler used to normalize conductivity to match the impedance of the thickest membrane may be a filler that impedes ion flow, and may be a ceramics or other inert nanoparticles, for example, magnesium oxide (MgO), calcium oxide (CaO).

In some embodiments, the increase in thicknesses of the membranes 202 may be linear, and the nanofiller concentration or amount or percentage may increase linearly as well. For example, a first membrane may be formed without nanofillers, and may be formed 25 micrometers thick, and subsequent membranes may have an impedance or conductivity adjusted to match. Thus, a second membrane 202 may be formed 50 micrometers thick and with 5% nanofiller, a third membrane may be formed 75 nanometers thick, and with 10% nanofiller, and so on. In other embodiments, membranes may have an impedance or conductivity adjusted to match a thickest membrane, so that a first membrane has a 25 μm thickness and 10% filler, and second membrane has a 50 μm thickness and 8% filler, a third membrane has a 75 μm thickness and 6% filler, with intervening layers with proportional thicknesses and filler proportions, and a final, thickest layer at 150 μm with no filler. In yet other embodiments, the thickness and nanofiller content for each membrane or stage may be specifically designed or engineered to achieve a desired thickness and impedance for a particular stage.

Low pressure hydrogen, or another feed gas, may be supplied at a low pressure input 206, and a voltage applied across the positive end plate 204 and negative end plate 208 to compress the hydrogen through the stages. The voltage may be applied by a voltage supply (not shown) at the positive end plate 204 and negative end plate 208, and the bipolar plates 212 and membranes 202 are effectively connected in series between the end plates 204, 208, with a substantially equivalent voltage drop across each membrane 202. The use of membrane 202 layers with substantially consistent impedances results in a substantially equal voltage drop at each stage. Applying a voltage across the stack, the multistage compressor operates in series, with virtually zero pressure drop between the stages. After compression, high pressure gas is removed through a high pressure outlet 210.

Figure 3:
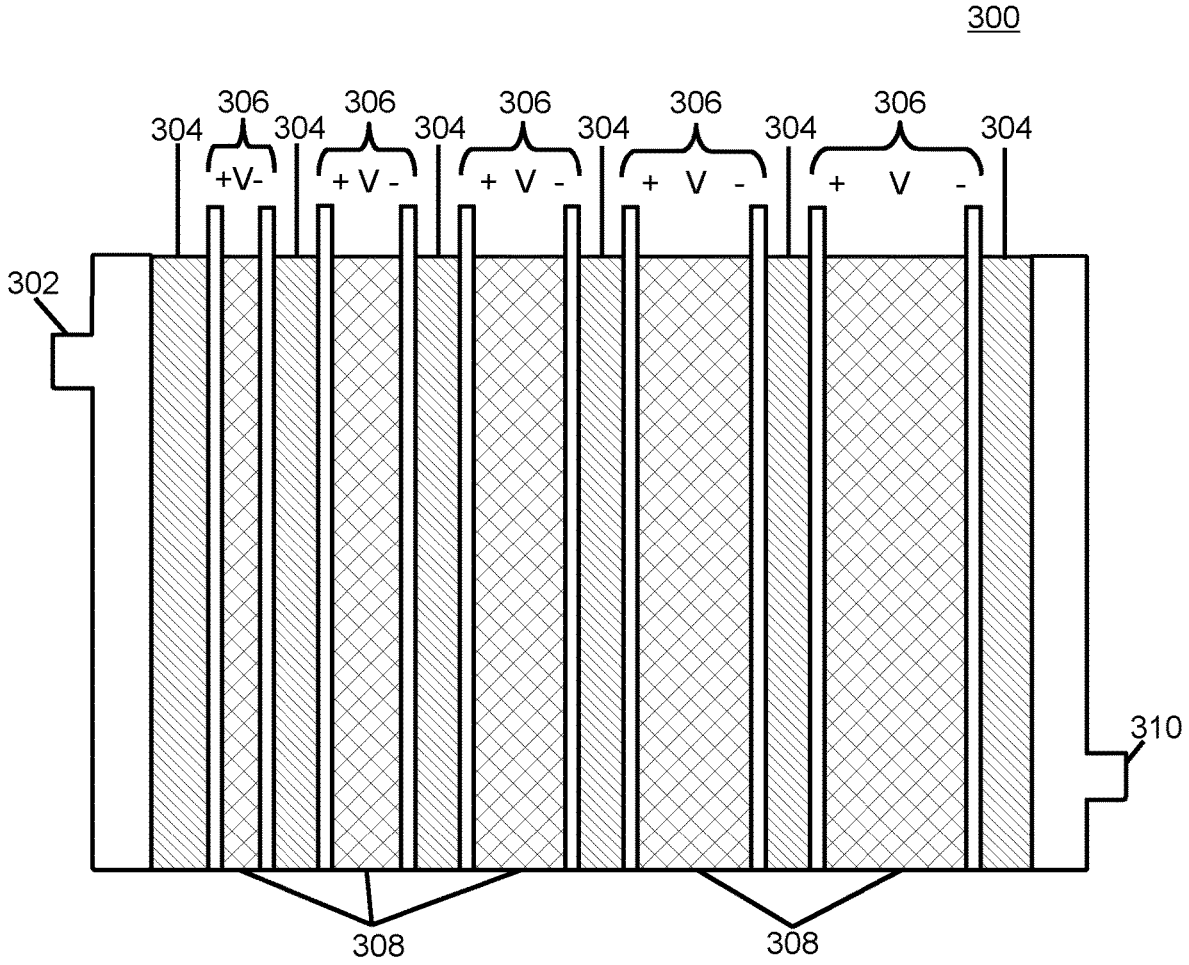
FIG. 3 is a is a diagram illustrating an electrochemical hydrogen compressor with stages electrically connected in parallel according to some embodiments.

FIG. 3 is a is a diagram illustrating an electrochemical hydrogen compressor 300 with stages electrically connected in parallel according to some embodiments. In some embodiments, the membranes of different stated in an EHC compressor may be selected or engineered according to the pressures the stage is intended to generate. Thus, the material for a lower pressure stage may be different than a material for a higher pressure stage. Each stage may be electrically operated in parallel so that a voltage or current density may be customized for the stage. This permits the use of the different membrane materials for the different stages, which may have different voltage requirements, impedances, and tolerances for different amounts of differential pressures. At higher pressures, thicker membranes, such as those made from PFSA or those made of different materials, such as aromatics, BPSH or the like, may be used to increase the compression per stage to achieve high efficiency.

Figure 4:
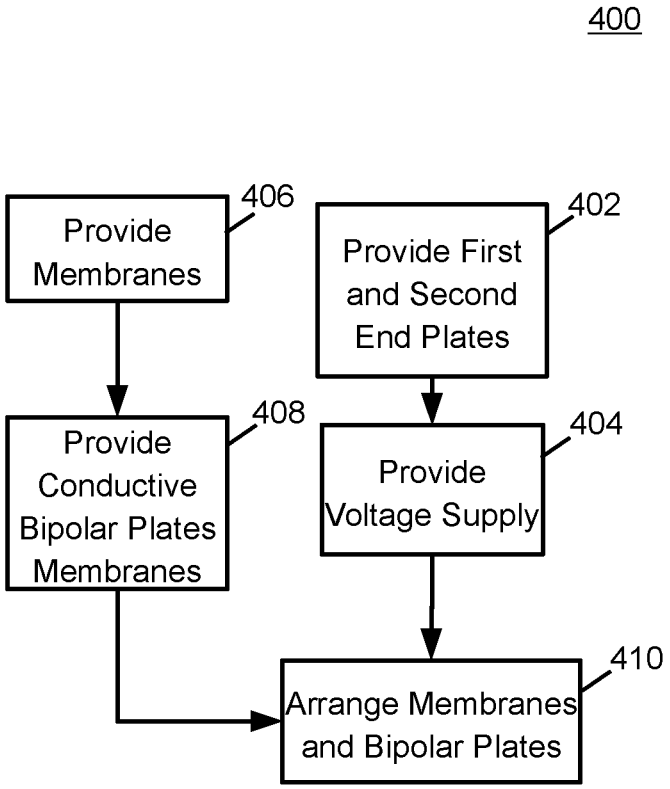
FIG. 4 is a flow diagram illustrating a method for providing a multistage electrochemical hydrogen compressor according to some embodiments.

Nonconductive support plates 304 are disposed between each stage. Each stage may include a polymer electrolyte membrane 308, and a pair of conductive gas diffusion electrodes (GDEs) 306. In some embodiments, a voltage is applied across each pair of GDEs 306, and the support plates 304 insulate the GDEs 306 of each stage from the GDEs 306 of other stages. In other embodiments, lightweight polymer bipolar plates can be used with the conductive GDEs 306, and the voltage may be applied to the bipolar plates. FIG. 4 is a flow diagram illustrating a method 400 for providing a multistage electrochemical hydrogen compressor according to some embodiments. In block 402, a first end plate and second end plate are provided. In block 404, a voltage supply is provided and electrically connected to the first and second end plates.

In block 406, a plurality of membranes is provided. Each membrane of the plurality of membranes has a substantially same impedance, and each membrane has a different thickness in a stacking direction. In some embodiments, the membranes are each cast with a different composition. At least one membrane of the plurality of membranes may comprise a nanofiller. In some embodiments, each of the membrane comprises a same base material and has a different concentration of the base material. In some embodiments, a membrane nearest the first end plate is free of nanofiller, and the others membranes comprise nanofiller at a different composition or concentration. In some embodiments, the thickness of each membrane is associated with a concentration of the base material, with thicker membranes having a lower base material concentration.

In block 408, a plurality of conductive bipolar plates is provided. In block 410, the bipolar plates are arranged to be in contact with, and alternating in the stacking direction with, the membranes. In some embodiments, each of the membranes is arranged between, and in direct contact with, two of the bipolar plates. The arranging results in the membranes and the bipolar plates being electrically connected in series between the first end plate and second end plate. The voltage supply is configured to apply a voltage across the membranes in series, wherein the voltage causes the membranes to compress a gas provided at the low pressure gas input and to provide pressurized gas at the high pressure gas outlet.

An electrochemical compressor according to the presented principles includes a first end plate, a second end plate, a voltage supply connected to the first end plate and second end plate, a plurality of membranes, where each membrane of the plurality of membranes has a substantially same impedance, and where each membrane of the plurality of membranes has a different thickness in a stacking direction, and a plurality of conductive bipolar plates, where the bipolar plates of the plurality of bipolar plates are arranged in contact with, and alternating in the stacking direction with, the membranes of the plurality of membranes, and where the membranes of the plurality of membranes and the bipolar plates of the plurality of bipolar plates are electrically connected in series between the first end plate and second end plate.

In some embodiments, each membrane of the plurality of membranes is a proton exchange membrane. In some embodiments, each membrane of the plurality of membranes has a different composition. In some embodiments, at least one membrane of the plurality of membranes includes a nanofiller. In some embodiments, each membrane of the plurality of membranes includes a same base material and has a different concentration of the base material. In some embodiments, the thickness of each membrane of the plurality of membranes is associated with a concentration of the base material. In some embodiments, each membrane of the plurality of membranes is disposed between, and in direct contact with, two bipolar plates of the plurality of bipolar plates.

An embodiment electrochemical compressor includes a first end plate, a second end plate, a high pressure gas outlet, a low pressure gas input, a plurality of membranes, where each membrane of the plurality of membranes has a substantially same impedance, and where each membrane of the plurality of membranes has a different thickness in a stacking direction, a plurality of conductive plates, where the plates of the plurality of plates are arranged in contact with, and alternating in the stacking direction with, the membranes of the plurality of membranes, and where the membranes of the plurality of membranes and the plates of the plurality of plates are electrically connected in series between the first end plate and second end plate, and a voltage supply connected to the first end plate and second end plate, the voltage supply configured to apply a voltage across the membranes in series, where the voltage causes the membranes to compress a gas provided at the low pressure gas input and to provide pressurized gas at the high pressure gas outlet.

In some embodiments, each membrane of the plurality of membranes is a proton exchange membrane configured to pass hydrogen ions. In some embodiments, each membrane of the plurality of membranes has a different composition. In some embodiments, at least one membrane of the plurality of membranes includes a nanofiller. In some embodiments, each membrane of the plurality of membranes includes a same base material and has a different concentration of the base material. In some embodiments, the thickness of each membrane of the plurality of membranes is associated with a concentration of the base material.

An embodiment method of forming an electrochemical compressor includes providing a first end plate, providing a second end plate, providing a voltage supply electrically connected to the first end plate and second end, providing a plurality of membranes, where each membrane of the plurality of membranes has a substantially same impedance, and where each membrane of the plurality of membranes has a different thickness in a stacking direction, providing a plurality of conductive bipolar plates, and arranging the bipolar plates of the plurality of bipolar plates in contact with, and alternating in the stacking direction with, the membranes of the plurality of membranes, where, after the arranging, the membranes of the plurality of membranes and the bipolar plates of the plurality of bipolar plates are electrically connected in series between the first end plate and second end plate.

In some embodiments, the providing the plurality of membranes includes casting each membrane of the plurality of membranes with a different composition. In some embodiments, at least one membrane of the plurality of membranes includes a nanofiller. In some embodiments, each membrane of the plurality of membranes includes a same base material and has a different concentration of the base material. In some embodiments, a first membrane nearest the first end plate is free of nanofiller, and where each other membrane of the plurality of membranes includes nanofiller at a different composition. In some embodiments, the thickness of each membrane of the plurality of membranes is associated with a concentration of the base material. In some embodiments, the arranging the bipolar plates of the plurality of bipolar plates in contact with the membranes of the plurality of membranes includes arranging each membrane of the plurality of membranes between, and in direct contact with, two bipolar plates of the plurality of bipolar plates.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An electrochemical compressor, comprising:

a first end plate;

a second end plate;

a voltage supply connected to the first end plate and second end plate;

a plurality of membranes, wherein each membrane of the plurality of membranes has a substantially same impedance, and wherein each membrane of the plurality of membranes has a different thickness in a stacking direction; and a plurality of conductive bipolar plates, wherein the bipolar plates of the plurality of bipolar plates are arranged in contact with, and alternating in the stacking direction with, the membranes of the plurality of membranes, and wherein the membranes of the plurality of membranes and the bipolar plates of the plurality of bipolar plates are electrically connected in series between the first end plate and second end plate.

2. The electrochemical compressor of claim 1, wherein each membrane of the plurality of membranes is a proton exchange membrane.

3. The electrochemical compressor of claim 1, wherein each membrane of the plurality of membranes has a different composition.

4. The electrochemical compressor of claim 3, wherein at least one membrane of the plurality of membranes comprises a nanofiller.

5. The electrochemical compressor of claim 3, wherein each membrane of the plurality of membranes comprises a same base material and has a different concentration of the base material.

6. The electrochemical compressor of claim 5, wherein the thickness of each membrane of the plurality of membranes is associated with a concentration of the base material.

7. The electrochemical compressor of claim 1, wherein each membrane of the plurality of membranes is disposed between, and in direct contact with, two bipolar plates of the plurality of bipolar plates.

8. An electrochemical compressor, comprising:

a first end plate;

a second end plate;

a high pressure gas outlet;

a low pressure gas input;

a plurality of membranes, wherein each membrane of the plurality of membranes has a substantially same impedance, and wherein each membrane of the plurality of membranes has a different thickness in a stacking direction;

a plurality of conductive plates, wherein the plates of the plurality of plates are arranged in contact with, and alternating in the stacking direction with, the membranes of the plurality of membranes, and wherein the membranes of the plurality of membranes and the plates of the plurality of plates are electrically connected in series between the first end plate and second end plate; and a voltage supply connected to the first end plate and second end plate, the voltage supply configured to apply a voltage across the membranes in series, wherein the voltage causes the membranes to compress a gas provided at the low pressure gas input and to provide pressurized gas at the high pressure gas outlet.

9. The electrochemical compressor of claim 8, wherein each membrane of the plurality of membranes is a proton exchange membrane configured to pass hydrogen ions.

10. The electrochemical compressor of claim 8, wherein each membrane of the plurality of membranes has a different composition.

11. The electrochemical compressor of claim 10, wherein at least one membrane of the plurality of membranes comprises a nanofiller.

12. The electrochemical compressor of claim 10, wherein each membrane of the plurality of membranes comprises a same base material and has a different concentration of the base material.

13. The electrochemical compressor of claim 12, wherein the thickness of each membrane of the plurality of membranes is associated with a concentration of the base material.

14. A method of forming an electrochemical compressor, comprising:

providing a first end plate;

providing a second end plate;

providing a voltage supply electrically connected to the first end plate and second end;

providing a plurality of membranes, wherein each membrane of the plurality of membranes has a substantially same impedance, and wherein each membrane of the plurality of membranes has a different thickness in a stacking direction;

providing a plurality of conductive bipolar plates; and arranging the bipolar plates of the plurality of bipolar plates in contact with, and alternating in the stacking direction with, the membranes of the plurality of membranes, wherein, after the arranging, the membranes of the plurality of membranes and the bipolar plates of the plurality of bipolar plates are electrically connected in series between the first end plate and second end plate.

15. The method of claim 14, wherein the providing the plurality of membranes comprises casting each membrane of the plurality of membranes with a different composition.

16. The method claim 15, wherein at least one membrane of the plurality of membranes comprises a nanofiller.

17. The method of claim 15, wherein each membrane of the plurality of membranes comprises a same base material and has a different concentration of the base material.

18. The method claim 15, wherein a first membrane nearest the first end plate is free of nanofiller, and wherein each other membrane of the plurality of membranes comprises nanofiller at a different composition.

19. The method of claim 17, wherein the thickness of each membrane of the plurality of membranes is associated with a concentration of the base material.

20. The method of claim 14, wherein the arranging the bipolar plates of the plurality of bipolar plates in contact with the membranes of the plurality of membranes comprises arranging each membrane of the plurality of membranes between, and in direct contact with, two bipolar plates of the plurality of bipolar plates.

* * * * *